US007753285B2

(12) United States Patent
Babaev

(10) Patent No.: US 7,753,285 B2
(45) **Date of Patent: *Jul. 13, 2010**

(54) ECHOING ULTRASOUND ATOMIZATION AND/OR MIXING SYSTEM

(75) Inventor: Eilaz Babaev, Minnetonka, MN (US)

(73) Assignee: Bacoustics, LLC, Minnetonka, MN (US)

( * ) Notice: Subject to any disclaimer, the term of this patent is extended or adjusted under 35 U.S.C. 154(b) by 363 days.

This patent is subject to a terminal disclaimer.

(21) Appl. No.: 11/777,934

(22) Filed: Jul. 13, 2007

(65) Prior Publication Data

US 2009/0014550 A1 Jan. 15, 2009

(51) Int. Cl.
*B05B 1/08* (2006.01)
*B05B 7/04* (2006.01)
*B05B 1/00* (2006.01)

(52) U.S. Cl. ..... 239/102.2; 239/102.1; 239/427; 239/427.3; 239/432; 239/434; 239/589; 239/601

(58) Field of Classification Search ..... 239/4, 239/102.1, 102.2, 398, 427–428, 429–434, 239/589, 601; 73/632, 644; 137/827, 828
See application file for complete search history.

(56) References Cited

U.S. PATENT DOCUMENTS 3,523,906 A 8/1970 Vrancken et al.
3,561,444 A 2/1971 Boucher
3,663,288 A 5/1972 Miller
3,779,792 A 12/1973 Stoy et al.
3,861,852 A 1/1975 Berger
3,924,335 A 12/1975 Balamuth et al.
3,970,250 A 7/1976 Drews
4,047,957 A 9/1977 De Winter et al.
4,100,309 A 7/1978 Micklus et al.
4,119,094 A 10/1978 Micklus et al.
4,153,201 A 5/1979 Berger et al.
4,168,447 A 9/1979 Bussiere et al.
4,169,984 A 10/1979 Parisi
4,263,188 A 4/1981 Hampton et al.
4,271,705 A 6/1981 Crostack
4,301,093 A 11/1981 Eck
4,301,968 A 11/1981 Berger et al.
4,306,998 A 12/1981 Wenzel et al.
4,309,989 A 1/1982 Fahim
4,319,155 A 3/1982 Nakai et al.

(Continued)

FOREIGN PATENT DOCUMENTS

EP 0416106 A1 3/1991
WO WO 2004075706 A1 * 9/2004

*Primary Examiner*—Darren W Gorman

(57) ABSTRACT

An ultrasound apparatus capable of mixing and/or atomizing fluids is disclosed. The apparatus includes a horn having an internal chamber through which fluids to be atomized and/or mixed flow. Connected to the horn's proximal end, a transducer powered by a generator induces ultrasonic vibrations within the horn. Traveling down the horn from the transducer, the ultrasonic vibrations induce the release of ultrasonic energy into the fluids to be atomized and/or mixed as they travel through the horn's internal chamber. As the ultrasonic vibrations travel through the chamber, the fluids within the chamber are agitated and/or begin to cavitate, thereby mixing the fluids. Upon reaching the front wall of the chamber, the ultrasonic vibrations are reflected back into the chamber, like an echo. The ultrasonic vibrations echoing off the front wall pass through the fluids within the chamber a second time, further mixing the fluids.

25 Claims, 4 Drawing Sheets

U.S. PATENT DOCUMENTS

| | | | | |
|---|---|---|---|---|
| 4,373,009 | A | | 2/1983 | Winn |
| 4,387,024 | A | | 6/1983 | Kurihara et al. |
| 4,389,330 | A | | 6/1983 | Tice et al. |
| 4,391,797 | A | | 7/1983 | Folkmam et al. |
| 4,402,458 | A | | 9/1983 | Lierke et al. |
| 4,459,317 | A | | 7/1984 | Lambert |
| 4,469,974 | A | | 9/1984 | Speranza |
| 4,474,326 | A | | 10/1984 | Takahashi |
| 4,483,571 | A | | 11/1984 | Mishiro |
| 4,487,808 | A | | 12/1984 | Lambert |
| 4,492,622 | A | | 1/1985 | Kuypers |
| 4,536,179 | A | | 8/1985 | Anderson et al. |
| 4,541,564 | A | * | 9/1985 | Berger et al. ..... 239/102.2 |
| 4,548,844 | A | | 10/1985 | Podell et al. |
| 4,582,654 | A | | 4/1986 | Karnicky et al. |
| 4,596,220 | A | | 6/1986 | Oosuga et al. |
| 4,642,267 | A | | 2/1987 | Creasy et al. |
| 4,646,967 | A | | 3/1987 | Geithman |
| 4,659,014 | A | | 4/1987 | Soth et al. |
| 4,666,437 | A | | 5/1987 | Lambert |
| 4,675,361 | A | | 6/1987 | Ward, Jr. |
| 4,684,328 | A | | 8/1987 | Murphy |
| 4,686,406 | A | | 8/1987 | Meitzler |
| 4,692,352 | A | | 9/1987 | Huddleston |
| 4,705,709 | A | | 11/1987 | Vailancourt |
| 4,715,353 | A | | 12/1987 | Koike et al. |
| 4,721,117 | A | | 1/1988 | Mar et al. |
| 4,726,525 | A | | 2/1988 | Yonekawa et al. |
| 4,732,322 | A | | 3/1988 | Gaysert et al. |
| 4,734,092 | A | | 3/1988 | Millerd |
| 4,748,986 | A | | 6/1988 | Morrison et al. |
| 4,764,021 | A | | 8/1988 | Eppes |
| 4,768,507 | A | | 9/1988 | Fischell et al. |
| 4,770,664 | A | | 9/1988 | Gogolewski |
| 4,793,339 | A | | 12/1988 | Matsumoto et al. |
| 4,795,458 | A | | 1/1989 | Regan |
| 4,796,807 | A | | 1/1989 | Bending et al. |
| 4,833,014 | A | | 5/1989 | Linder et al. |
| 4,834,124 | A | | 5/1989 | Honda |
| 4,841,976 | A | | 6/1989 | Packard et al. |
| 4,850,534 | A | | 7/1989 | Takahashi et al. |
| 4,867,173 | A | | 9/1989 | Leoni et al. |
| 4,876,126 | A | | 10/1989 | Takemura et al. |
| 4,877,989 | A | | 10/1989 | Drews et al. |
| 4,884,579 | A | | 12/1989 | Engelson |
| 4,923,464 | A | | 5/1990 | Di Pisa, Jr. |
| 4,925,698 | A | | 5/1990 | Klausner et al. |
| 4,943,460 | A | | 7/1990 | Markle et al. |
| 4,945,937 | A | | 8/1990 | Scribner |
| 4,959,074 | A | | 9/1990 | Halpern et al. |
| 4,964,409 | A | | 10/1990 | Tremulis |
| 4,969,890 | A | | 11/1990 | Sugita et al. |
| 4,980,231 | A | | 12/1990 | Baker et al. |
| 4,995,367 | A | | 2/1991 | Yamauchi et al. |
| 5,002,582 | A | | 3/1991 | Guire et al. |
| 5,007,928 | A | | 4/1991 | Okamura et al. |
| 5,008,363 | A | | 4/1991 | Mallon et al. |
| 5,017,383 | A | | 5/1991 | Ozawa et al. |
| 5,019,400 | A | | 5/1991 | Gombotz et al. |
| 5,025,766 | A | | 6/1991 | Yamauchi et al. |
| 5,026,607 | A | | 6/1991 | Kiezulas |
| 5,037,656 | A | | 8/1991 | Pitt et al. |
| 5,037,677 | A | | 8/1991 | Halpern et al. |
| 5,040,543 | A | | 8/1991 | Badera et al. |
| 5,049,403 | A | | 9/1991 | Larm et al. |
| 5,057,371 | A | | 10/1991 | Cantry et al. |
| 5,066,705 | A | | 11/1991 | Wickert |
| 5,067,489 | A | | 11/1991 | Lind |
| 5,069,217 | A | | 12/1991 | Fleischhacker, Jr. |
| 5,069,226 | A | | 12/1991 | Yamauchi et al. |
| 5,076,266 | A | | 12/1991 | Babaev |
| 5,079,093 | A | | 1/1992 | Akashi et al. |
| 5,080,683 | A | | 1/1992 | Sulc et al. |
| 5,080,924 | A | | 1/1992 | Kamel et al. |
| 5,084,315 | A | | 1/1992 | Karimi et al. |
| 5,091,205 | A | | 2/1992 | Fan |
| 5,099,815 | A | | 3/1992 | Yamauchi et al. |
| 5,100,669 | A | | 3/1992 | Hyon et al. |
| 5,102,401 | A | | 4/1992 | Lambert et al. |
| 5,102,402 | A | | 4/1992 | Dror et al. |
| 5,102,417 | A | | 4/1992 | Palmaz |
| 5,105,010 | A | | 4/1992 | Sundaearaman et al. |
| 5,107,852 | A | | 4/1992 | Davidson et al. |
| 5,128,170 | A | | 7/1992 | Matsuda et al. |
| 5,134,993 | A | | 8/1992 | Van der Linden et al. |
| 5,147,370 | A | | 9/1992 | McNamara et al. |
| 5,160,790 | A | | 11/1992 | Elton |
| 5,211,183 | A | | 5/1993 | Wilson |
| 5,213,111 | A | | 5/1993 | Cook et al. |
| 5,217,026 | A | | 6/1993 | Stoy et al. |
| 5,234,457 | A | | 8/1993 | Andersen |
| 5,240,994 | A | | 8/1993 | Brink et al. |
| 5,241,970 | A | | 9/1993 | Johlin, Jr. et al. |
| 5,243,996 | A | | 9/1993 | Hall |
| 5,250,613 | A | | 10/1993 | Bergstrom et al. |
| 5,266,359 | A | | 11/1993 | Spievogel |
| 5,275,173 | A | | 1/1994 | Samson et al. |
| 5,282,823 | A | | 2/1994 | Schwartz et al. |
| 5,283,063 | A | | 2/1994 | Freeman |
| 5,290,585 | A | | 3/1994 | Elton |
| 5,304,121 | A | | 4/1994 | Sahatjian |
| 5,304,140 | A | | 4/1994 | Kugo et al. |
| 5,315,998 | A | | 5/1994 | Tachibana et al. |
| 5,326,164 | A | | 7/1994 | Logan |
| 5,336,534 | A | | 8/1994 | Nakajima et al. |
| 5,344,426 | A | | 9/1994 | Lau et al. |
| 5,370,614 | A | | 12/1994 | Amundson et al. |
| 5,380,299 | A | | 1/1995 | Fearnot et al. |
| 5,389,379 | A | | 2/1995 | Dirix et al. |
| 5,419,760 | A | | 5/1995 | Narciso, Jr. |
| 5,426,885 | A | | 6/1995 | Wittman |
| 5,443,458 | A | | 8/1995 | Eury |
| 5,443,496 | A | | 8/1995 | Schwartz et al. |
| 5,447,724 | A | | 9/1995 | Helmus et al. |
| 5,449,372 | A | | 9/1995 | Schmaltz et al. |
| 5,449,382 | A | | 9/1995 | Dayton |
| 5,464,650 | A | | 11/1995 | Berg et al. |
| 5,470,829 | A | | 11/1995 | Prisell et al. |
| 5,476,909 | A | | 12/1995 | Kim et al. |
| 5,512,055 | A | | 4/1996 | Domb et al. |
| 5,514,154 | A | | 5/1996 | Lau et al. |
| 5,515,841 | A | | 5/1996 | Robertson et al. |
| 5,515,842 | A | | 5/1996 | Ramseyer et al. |
| 5,516,043 | A | | 5/1996 | Manna et al. |
| 5,527,337 | A | | 6/1996 | Stack et al. |
| 5,529,635 | A | | 6/1996 | Odell |
| 5,545,208 | A | | 8/1996 | Wolff et al. |
| 5,548,035 | A | | 8/1996 | Kim et al. |
| 5,551,416 | A | | 9/1996 | Stimpson et al. |
| 5,562,922 | A | | 10/1996 | Lambert |
| 5,569,463 | A | | 10/1996 | Helmus et al. |
| 5,576,072 | A | | 11/1996 | Hostettler et al. |
| 5,578,075 | A | | 11/1996 | Dayton |
| 5,591,227 | A | | 1/1997 | Dinh et al. |
| 5,597,292 | A | | 1/1997 | Rhee et al. |
| 5,605,696 | A | | 2/1997 | Eury et al. |
| 5,609,629 | A | | 3/1997 | Fearnot et al. |
| 5,616,608 | A | | 4/1997 | Kinsella et al. |
| 5,620,738 | A | | 4/1997 | Fan et al. |
| 5,624,411 | A | | 4/1997 | Tuch |
| 5,626,862 | A | | 5/1997 | Brem et al. |
| 5,637,113 | A | | 6/1997 | Tartaglia et al. |
| 5,656,036 | A | | 8/1997 | Palmaz |
| 5,674,192 | A | | 10/1997 | Sahatjian et al. |

5,674,241 A 10/1997 Bley et al.
5,674,242 A 10/1997 Phan et al.
5,679,400 A 10/1997 Tuch
5,697,967 A 12/1997 Dinh et al.
5,700,286 A 12/1997 Tartaglia et al.
5,702,754 A 12/1997 Zhong
5,709,874 A 1/1998 Hanson et al.
5,712,326 A 1/1998 Jones et al.
5,716,981 A 2/1998 Hunter et al.
5,733,925 A 3/1998 Kunz et al.
5,736,100 A 4/1998 Miyake et al.
5,739,237 A 4/1998 Russell et al.
5,755,769 A 5/1998 Richard et al.
5,776,184 A 7/1998 Tuch
5,785,972 A 7/1998 Tyler
5,799,732 A 9/1998 Gonzalez et al.
5,803,106 A 9/1998 Cohen et al.
5,837,008 A 11/1998 Berg et al.
5,868,153 A 2/1999 Cohen et al.
5,902,332 A 5/1999 Schatz
5,957,975 A 9/1999 Lafont et al.
5,972,027 A 10/1999 Johnson
6,041,253 A 3/2000 Kost et al.
6,053,424 A 4/2000 Gipson et al.
6,077,543 A 6/2000 Gordon et al.
6,099,561 A 8/2000 Alt
6,099,562 A 8/2000 Ding et al.
6,099,563 A 8/2000 Zhong
6,102,298 A 8/2000 Bush
6,104,952 A 8/2000 Tu et al.
6,120,536 A 9/2000 Ding et al.
6,190,315 B1 2/2001 Kost et al.
6,231,600 B1 5/2001 Zhong
6,234,765 B1 5/2001 Deak
6,234,990 B1 5/2001 Rowe et al.
6,244,738 B1 6/2001 Yasuda et al.
6,251,099 B1 6/2001 Kollias et al.
6,258,121 B1 7/2001 Yang et al.
6,287,285 B1 9/2001 Michael et al.
6,296,630 B1 10/2001 Altman et al.
6,299,604 B1 10/2001 Ragheb et al.
6,306,166 B1 10/2001 Barry et al.
6,315,215 B1 11/2001 Gipson et al.
6,335,029 B1 1/2002 Kamath et al.
6,357,671 B1 3/2002 Cewers
6,369,039 B1 4/2002 Palasis et al.
6,450,417 B1 9/2002 Gipson et al.
6,478,754 B1 11/2002 Babaev
6,560,548 B1 5/2003 Roudil et al.
6,568,052 B1 5/2003 Rife et al.
6,569,099 B1 5/2003 Babaev
6,601,581 B1 8/2003 Babaev
6,663,554 B2 12/2003 Babaev
6,706,288 B2 3/2004 Gustavsson et al.
6,720,710 B1 4/2004 Wenzel et al.
6,723,064 B2 4/2004 Babaev
6,730,349 B2 5/2004 Schwartz
6,737,021 B2 5/2004 Watari et al.
6,776,352 B2 8/2004 Jameson
6,811,805 B2 11/2004 Gilliard et al.
6,837,445 B1 1/2005 Tsai
6,840,280 B1 1/2005 Simon
6,861,088 B2 3/2005 Weber et al.
6,883,729 B2 4/2005 Putvinski et al.
7,044,163 B1 5/2006 Fan et al.
7,060,319 B2 6/2006 Fredrickson
7,077,860 B2 7/2006 Yan et al.
7,178,554 B2 2/2007 Tanner et al.
2002/0127346 A1 9/2002 Herber
2003/0098364 A1 5/2003 Jameson
2003/0223886 A1 12/2003 Keilman
2004/0039375 A1 2/2004 Miyazawa
2004/0045547 A1 3/2004 Yamamoto et al.
2004/0191405 A1 9/2004 Kerrigan
2004/0197585 A1 10/2004 Hughes et al.
2004/0204680 A1 10/2004 Lal et al.
2004/0204750 A1 10/2004 Dinh
2004/0211362 A1 10/2004 Castro et al.
2004/0215313 A1 10/2004 Cheng
2004/0215336 A1 10/2004 Udipi et al.
2004/0220610 A1 11/2004 Kreidler et al.
2004/0224001 A1 11/2004 Pacetti et al.
2004/0234748 A1 11/2004 Stenzel
2004/0236399 A1 11/2004 Sundar
2004/0249449 A1 12/2004 Shanley et al.
2005/0043788 A1 2/2005 Luo et al.
2005/0058768 A1 3/2005 Teichman
2005/0064088 A1 3/2005 Fredrickson
2005/0070936 A1 3/2005 Pacetti
2005/0070997 A1 3/2005 Thornton et al.
2006/0191562 A1* 8/2006 Nunomura et al. ..... 134/184
2006/0266426 A1* 11/2006 Tanner et al. ..... 137/828
2007/0051307 A1 3/2007 Babaev
2007/0295832 A1 12/2007 Gibson et al.
2008/0006714 A1 1/2008 McNichols et al.

* cited by examiner

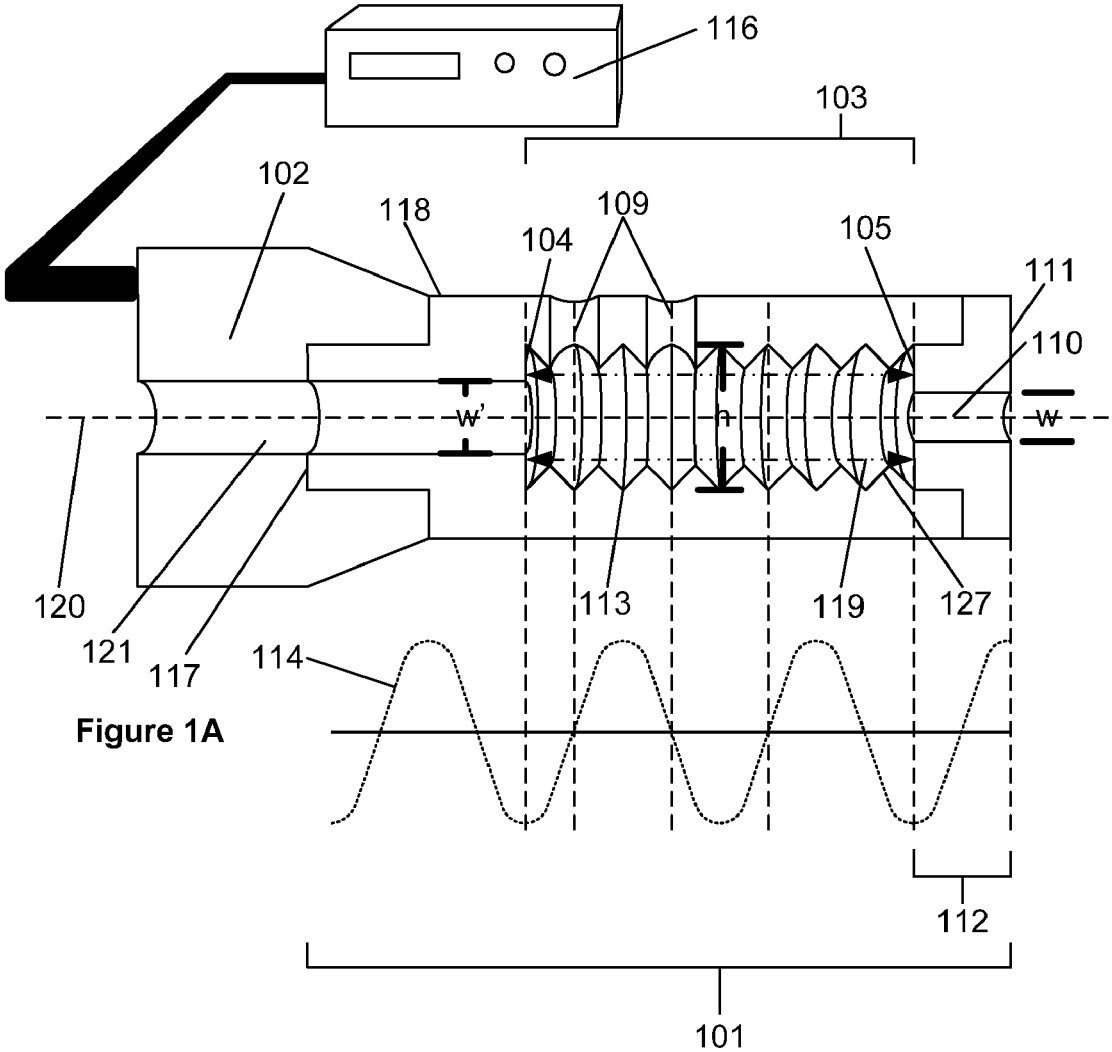
Figure 1A
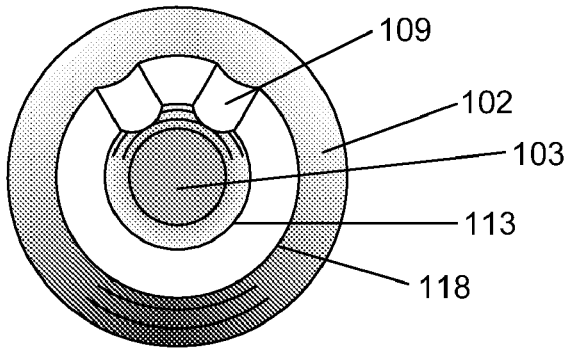
Figure 1B
Figure 1

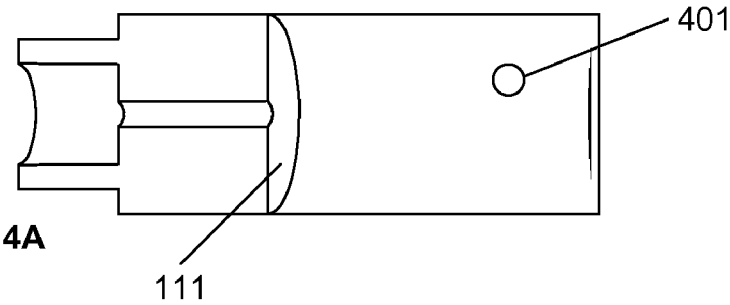
Figure 4A
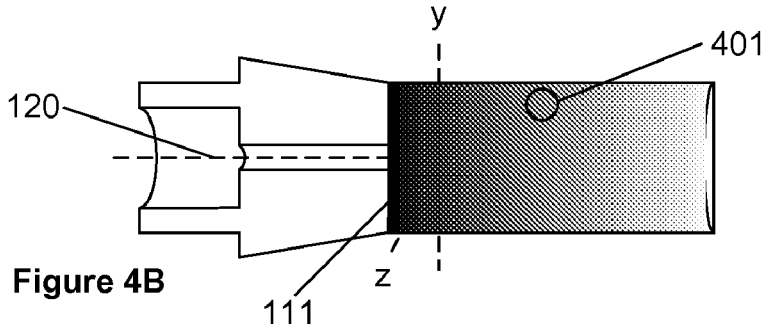
Figure 4B
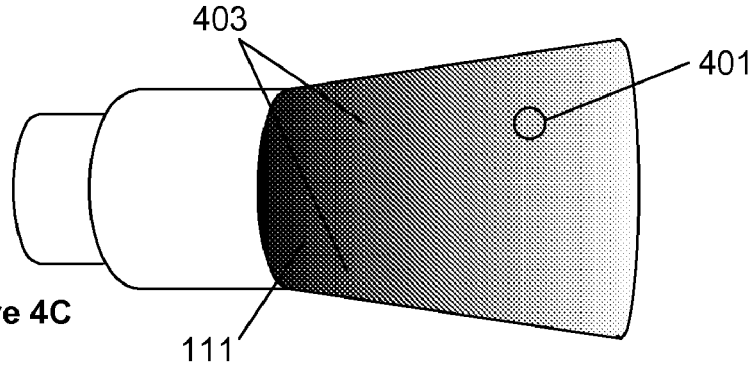
Figure 4C
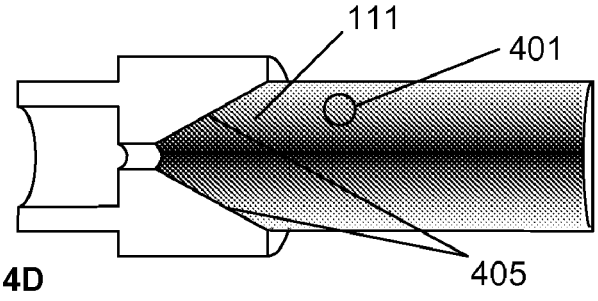
Figure 4D
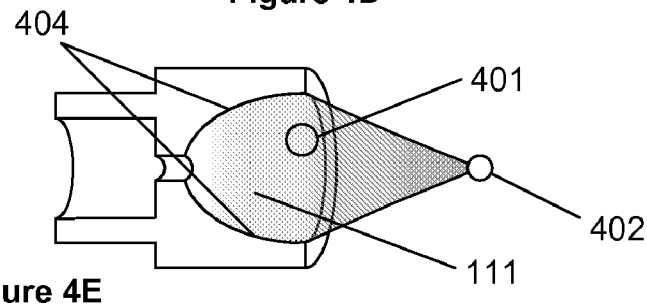
Figure 4E
Figure 4

ECHOING ULTRASOUND ATOMIZATION AND/OR MIXING SYSTEM

BACKGROUND OF THE INVENTION

1. Field of the Invention

The present invention relates to an apparatus utilizing ultrasonic waves traveling through a horn and/or resonant structure to atomize, assist in the atomization of, and/or mix fluids passing through the horn and/or resonant structure 2. Background of the Related Art Liquid atomization is a process by which a liquid is separated into small droplets by some force acting on the liquid, such as ultrasound. Exposing a liquid to ultrasound creates vibrations and/or cavitations within the liquid that break it apart into small droplets. U.S. Pat. No. 4,153,201 to Berger et al., U.S. Pat. No. 4,655,393 to Berger, and U.S. Pat. No. 5,516,043 to Manna et al. describe examples of atomization systems utilizing ultrasound to atomize a liquid. These devices possess a tip vibrated by ultrasonic waves passing through the tip. Within the tips are central passages that carry the liquid to be atomized. The liquid within the central passage is driven towards the end of the tip by some force acting upon the liquid. Upon reaching the end of the tip, the liquid to be atomized is expelled from tip. Ultrasonic waves emanating from the front of the tip then collide with the liquid, thereby breaking the liquid apart into small droplets. Thus, the liquid is not atomized until after it leaves the ultrasound tip because only then is the liquid exposed to collisions with ultrasonic waves.

SUMMARY OF THE INVENTION

An ultrasound apparatus capable of mixing and/or atomizing fluids is disclosed. The apparatus comprises a horn having an internal chamber including a back wall, a front wall, and at least one side wall, a radiation surface at the horn's distal end, at least one channel opening into the chamber, and a channel originating in the front wall of the internal chamber and terminating in the radiation surface. Connected to the horn's proximal end, a transducer powered by a generator induces ultrasonic vibrations within the horn. Traveling down the horn from the transducer to the horn's radiation surface, the ultrasonic vibrations induce the release of ultrasonic energy into the fluids to be atomized and/or mixed as they travel through the horn's internal chamber and exit the horn at the radiation surface. As the ultrasonic vibrations travel through the chamber, the fluids within the chamber are agitated and/or begin to cavitate, thereby mixing the fluids. Upon reaching the front wall of the chamber, the ultrasonic vibrations are reflected back into the chamber, like an echo. The ultrasonic vibrations echoing off the front wall pass through the fluid within the chamber a second time, further mixing the fluids.

As the vibrations travel back-and-forth within the chamber, the may strike protrusions located on the side walls of the chamber. After striking the protrusion on the side walls of the chamber, the vibrations may be scattered about the chamber. Consequently, some the vibrations echoing off the side wall protrusions may be reflected back towards the wall of the chamber from which they originated. Some the vibrations will may continue on towards the opposite the wall of the chamber. The remainder of the vibrations may travel towards another side wall of the chamber where they will be scattered once by the protrusion. Therefore, the echoing action of ultrasonic vibrations within the chamber may be enhanced by the protrusions on the side walls of the chamber. Emitting ultrasonic vibrations into the chamber from their distal facing edges, the protrusions within the inner chamber may also enhance the mixing of the fluids within the chamber by increasing the amount of ultrasonic vibrations within the chamber.

The protrusions may be formed in a variety of shapes such as, but not limited to, convex, spherical, triangular, rectangular, polygonal, and/or any combination thereof. The protrusions may be discrete elements. Alternatively, the protrusions may be discrete bands encircling the internal chamber. The protrusions may also spiral down the chamber similar to the threading within a nut.

As with typical pressure driven fluid atomizers, the ultrasound atomization and/or mixing apparatus is capable of utilizing pressure changes within the fluids passing through the apparatus to drive atomization. The fluids to be atomized and/or mixed enter the apparatus through one or multiple channels opening into the internal chamber. The fluids then flow through the chamber and into a channel extending from the chamber's front wall to the radiation surface. If the channel originating in the front wall of the internal chamber is narrower than the chamber, the pressure of the fluid flowing through the channel decreases and the fluid's velocity increases. Because the fluids' kinetic energy is proportional to velocity squared, the kinetic energy of the fluids increases as they flow through the channel. The pressure of the fluids is thus converted to kinetic energy as the fluids flow through the channel. Breaking the attractive forces between the molecules of the fluids, the increased kinetic energy of the fluids causes the fluids to atomize as they exit the horn at the radiation surface.

By agitating and/or inducing cavitations within fluids passing through the internal chamber, ultrasonic energy emanating from various points of the atomization and/or mixing apparatus thoroughly mixes fluids as they pass through the internal chamber. When the proximal end of the horn is secured to an ultrasound transducer, activation of the transducer induces ultrasonic vibrations within the horn. The vibrations can be conceptualized as ultrasonic waves traveling from the proximal end to the distal end of horn. As the ultrasonic vibrations travel down the length of the horn, the horn contracts and expands. However, the entire length of the horn is not expanding and contracting. Instead, the segments of the horn between the nodes of the ultrasonic vibrations (points of minimum deflection or amplitude) are expanding and contracting. The portions of the horn lying exactly on the nodes of the ultrasonic vibrations are not expanding and contracting. Therefore, only the segments of the horn between the nodes are expanding and contracting, while the portions of the horn lying exactly on nodes are not moving. It is as if the ultrasound horn has been physically cut into separate pieces. The pieces of the horn corresponding to nodes of the ultrasonic vibrations are held stationary, while the pieces of the horn corresponding to the regions between nodes are expanding and contracting. If the pieces of the horn corresponding to the regions between nodes were cut up into even smaller pieces, the pieces expanding and contracting the most would be the pieces corresponding to the antinodes of ultrasonic vibrations (points of maximum deflection or amplitude).

The amount of mixing that occurs within the chamber can be adjusted by changing the locations of the chamber's front and back walls with respect to ultrasonic vibrations passing through the horn. Moving forwards and backwards, the back wall of the chamber induces ultrasonic vibrations in the fluids within the chamber. As the back wall moves forward it hits the fluids. Striking the fluids, like a mallet hitting a gong, the back wall induces ultrasonic vibrations that travel through the fluids. The vibrations traveling through the fluids possess the same frequency as the ultrasonic vibrations traveling through horn. The farther forwards and backwards the back wall of the chamber moves, the more forcefully the back wall strikes the fluids within the chamber and the higher the amplitude of the ultrasonic vibrations within the fluids.

When the ultrasonic vibrations traveling through the fluids within the chamber strike the front wall of the chamber, the front wall compresses forwards. The front wall then rebounds backwards, striking the fluids within the chamber, and thereby creates an echo of the ultrasonic vibrations that struck the front wall. If the front wall of the chamber is struck by an antinode of the ultrasonic vibrations traveling through chamber, then the front wall will move as far forward and backward as is possible. Consequently, the front wall will strike the fluids within the chamber more forcefully and thus generate an echo with the largest possible amplitude. If, however, the ultrasonic vibrations passing through the chamber strike the front wall of the chamber at a node, then the front wall will not be forced forward because there is no movement at a node. Consequently, an ultrasonic vibration striking the front wall at a node will not produce an echo.

Positioning the front and back walls of the chamber such that at least one point on both, preferably their centers, lie approximately on antinodes of the ultrasonic vibrations passing through the chamber maximizes the amount of mixing occurring within the chamber. Moving the back wall of the chamber away from an antinode and towards a node decreases the amount of mixing induced by ultrasonic vibrations emanating from the back wall. Likewise, moving the front wall of the chamber away from an antinode and towards a node decreases the amount of mixing induced by ultrasonic vibrations echoing off the front wall. Therefore, positioning the front and back walls of the chamber such that center of both the front and back wall lie approximately on nodes of the ultrasonic vibrations passing through the chamber minimizes the amount of mixing within the chamber.

The amount of mixing that occurs within the chamber can also be adjusted by controlling the volume of the fluids within the chamber. Ultrasonic vibrations within the chamber may cause atomization of the fluids, especially liquids. As the fluids atomize, their volumes increase which may cause the fluids to separate. However, if the fluids completely fill the chamber, then there is no room in the chamber to accommodate an increase in the volume of the fluids. Consequently, the amount of atomization occurring within the chamber when the chamber is completely filled with the fluids will be decreased and the amount of mixing increased.

The ultrasonic echoing properties of the chamber may also be enhanced by including an ultrasonic lens within the front wall of the chamber. Ultrasonic vibrations striking the lens within the front wall of the chamber are directed to reflect back into the chamber in a specific manner depending upon the configuration of the lens. For instance, a lens within the front wall of the chamber may contain a concave portion. Ultrasonic vibrations striking the concave portion of the lens would be reflected towards the side walls. Upon impacting a side wall, the ultrasonic vibrations would be reflected again off the side wall's protrusions. Scattering as they reflected off protrusion, the vibrations wound travel towards the various walls of the chambers, and would thus echo throughout the chamber. If the concaved portion or portions within the lens form an overall parabolic configuration in at least two dimensions, then the ultrasonic vibrations echoing off the lens and/or the energy they carry may be focused towards the focus of the parabola before striking chamber's side walls.

In combination or in the alternative, the lens within the front wall of the chamber may also contain a convex portion. Again, ultrasonic vibrations emitted from the chamber's back wall striking the lens within the front wall would be directed to reflect back into and echo throughout the chamber in a specific manner. However, instead of being directed towards a focal point as with a concave portion, the ultrasonic vibrations echoing off the convex portion are reflected in a dispersed manner.

In combination or in the alternative, the back wall of the chamber may also contain an ultrasonic lens possessing concave and/or convex portions. Such portions within the back wall lens of the chamber function similarly to their front wall lens equivalents, except that in addition to directing and/or focusing echoing ultrasonic vibrations, they also direct and/or focus the ultrasonic vibrations as they are emitted into the chamber.

The amount of mixing occurring within the internal chamber may be controlled by adjusting the amplitude of the ultrasonic vibrations traveling down the length of the horn. Increasing the amplitude of the ultrasonic vibrations increases the degree to which the fluids within the chamber are agitated and/or cavitated. If the horn is ultrasonically vibrated in resonance by a piezoelectric transducer driven by an electrical signal supplied by a generator, then increasing the voltage of the electrical signal will increase the amplitude of the ultrasonic vibrations traveling down the horn.

As with typical pressure driven fluid atomizers, the ultrasound atomization apparatus utilizes pressure changes within the fluid to create the kinetic energy that drives atomization. Unfortunately, pressure driven fluid atomization can be adversely impacted by changes in environmental conditions. Most notably, a change in the pressure of the environment into which the atomized fluid is to be sprayed may decrease the level of atomization and/or distort the spray pattern. As a fluid passes through a pressure driven fluid atomizer, it is pushed backwards by the pressure of the environment. Thus, the net pressure acting on the fluid is the difference of the pressure pushing the fluid through the atomizer and the pressure of the environment. It is the net pressure of the fluid that is converted to kinetic energy. Thus, as the environmental pressure increases, the net pressure decreases, causing a reduction in the kinetic energy of the fluid exiting the horn. An increase in environmental pressure, therefore, reduces the level of fluid atomization.

A counteracting increase in the kinetic energy of the fluid may be induced from the ultrasonic vibrations emanating from the radiation surface. Like the back wall of the internal chamber, the radiation surface is also moving forwards and backwards when ultrasonic vibrations travel down the length of the horn. Consequently, as the radiation surface moves forward it strikes the fluids exiting the horn and the surrounding air. Striking the exiting fluids and surrounding air, the radiation surface emits, or induces, vibrations within the exiting fluids. As such, the kinetic energy of the exiting fluids increases. The increased kinetic energy further atomizes the fluids exiting at the radiation surface, thereby counteracting a decrease in atomization caused by changing environmental conditions.

The increased kinetic energy imparted on the fluids by the movement of the radiation surface can be controlled by adjusting the amplitude of the ultrasonic vibrations traveling down the length of the horn. Increasing the amplitude of the ultrasonic vibrations increases the amount of kinetic energy imparted on the fluids as they exit at the radiation surface.

As with increases in environmental pressure, decreases in environmental pressure may adversely impact the atomized spray. Because the net pressure acting on the fluids is converted to kinetic energy and the net pressure acting on the fluids is the difference of the pressure pushing the fluids through the atomizer and the pressure of the environment, decreasing the environmental pressure increases the kinetic energy of the fluids exiting a pressure driven atomizer. Thus, as the environmental pressure decreases, the exiting velocity of the fluids increases. Exiting the atomizer at a higher velocity, the atomized fluid droplets move farther away from the atomizer, thereby widening the spray pattern. Changing the spray pattern may lead to undesirable consequences. For instance, widening the spray pattern may direct the atomized fluids away from their intended target and/or towards unintended targets. Thus, a decrease in environmental pressure may result in a detrimental un-focusing of the atomized spray.

Adjusting the amplitude of the ultrasonic waves traveling down the length of the horn may be useful in focusing the atomized spray produced at the radiation surface. Creating a focused spray may be accomplished by utilizing the ultrasonic vibrations emanating from the radiation surface to confine and direct the spray pattern. Ultrasonic vibrations emanating from the radiation surface may direct and confine the vast majority of the atomized spray produced within the outer boundaries of the radiation surface. The level of confinement obtained by the ultrasonic vibrations emanating from the radiation surface depends upon the amplitude of the ultrasonic vibrations traveling down the horn. As such, increasing the amplitude of the ultrasonic vibrations passing through the horn may narrow the width of the spray pattern produced; thereby focusing the spray. For instance, if the spray is fanning too wide, increasing the amplitude of the ultrasonic vibrations may narrow the spray pattern. Conversely, if the spray is too narrow, then decreasing the amplitude of the ultrasonic vibrations may widen the spray pattern.

Changing the geometric conformation of the radiation surface may also alter the shape of the spray pattern. Producing a roughly column-like spray pattern may be accomplished by utilizing a radiation surface with a planar face. Generating a spray pattern with a width smaller than the width of the horn may be accomplished by utilizing a tapered radiation surface. Further focusing of the spray may be accomplished by utilizing a concave radiation surface. In such a configuration, ultrasonic waves emanating from the concave radiation surface may focus the spray through the focus of the radiation surface. If it is desirable to focus, or concentrate, the spray produced towards the inner boundaries of the radiation surface, but not towards a specific point, then utilizing a radiation surface with slanted portions facing the central axis of the horn may be desirable. Ultrasonic waves emanating from the slanted portions of the radiation surface may direct the atomized spray inwards, towards the central axis. There may, of course, be instances where a focused spray is not desirable. For instance, it may be desirable to quickly apply an atomized liquid to a large surface area. In such instances, utilizing a convex radiation surface may produce a spray pattern with a width wider than that of the horn. The radiation surface utilized may possess any combination of the above mentioned configurations such as, but not limited to, an outer concave portion encircling an inner convex portion and/or an outer planar portion encompassing an inner conical portion. Inducing resonating vibrations within the horn facilitates the production of the spray patterns described above, but may not be necessary.

It should be noted and appreciated that other benefits and/or mechanisms of operation, in addition to those listed, may be elicited by devices in accordance with the present invention. The mechanisms of operation presented herein are strictly theoretical and are not meant in any way to limit the scope this disclosure and/or the accompanying claims.

BRIEF DESCRIPTION OF THE DRAWINGS

The ultrasound atomization apparatus will be shown and described with reference to the drawings of preferred embodiments and clearly understood in details.

FIG. 1 illustrates cross-sectional views of an embodiment of the ultrasound atomization and/or mixing apparatus.

FIG. 4 illustrates alternative embodiments of the radiation surface.

DETAILED DESCRIPTION OF THE INVENTION

Figure 2:
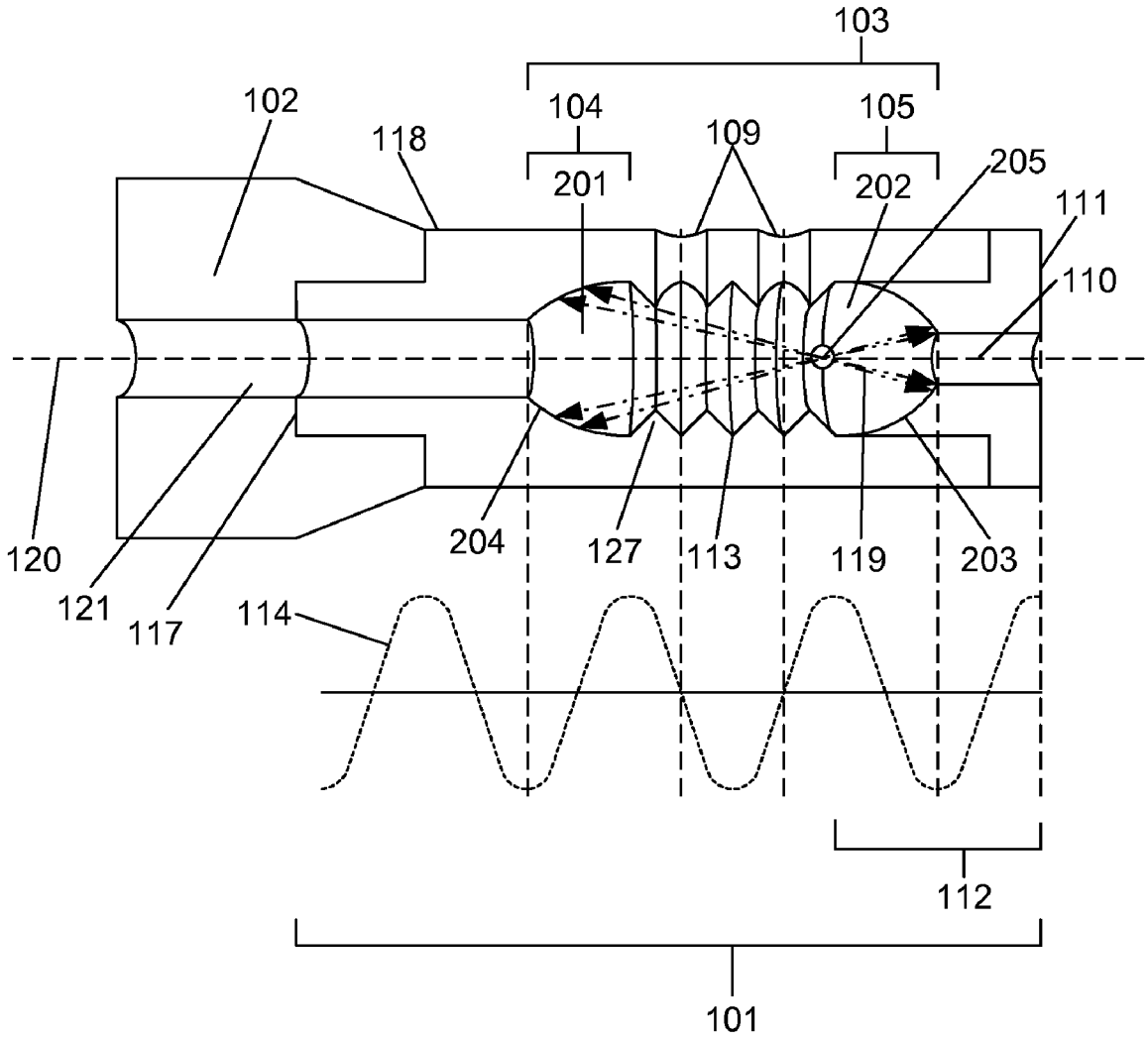
FIG. 2 illustrates a cross-sectional view of an alternative embodiment of the ultrasound atomizing and/or mixing apparatus wherein the back wall and front wall contain lenses with concave portions.

Preferred embodiments of the ultrasound atomization and/or mixing apparatus are illustrated throughout the figures and described in detail below. Those skilled in the art will immediately understand the advantages for mixing and/or atomizing material provided by the atomization and/or mixing apparatus upon review.

FIG. 1 illustrates an embodiment of the ultrasound atomization and/or mixing apparatus comprising a horn 101 and an ultrasound transducer 102 attached to the proximal surface 117 of horn 101 powered by generator 116. As ultrasound transducers and generators are well known in the art they need not and will not, for the sake of brevity, be described in detail herein. Ultrasound horn 101 comprises a proximal surface 117, a radiation surface 111 opposite proximal end 117, and at least one radial surface 118 extending between proximal surface 117 and radiation surface 111. Within horn 101 is an internal chamber 103 containing a back wall 104, a front wall 105, at least one side wall 113 extending between back wall 104 and front wall 105, and protrusion 127 located on side wall 113 and extending into chamber 103. As to induce vibrations within horn 101, ultrasound transducer 102 may be mechanically coupled to proximal surface 117. Mechanically coupling horn 101 to transducer 102 may be achieved by mechanically attaching (for example, securing with a threaded connection), adhesively attaching, and/or welding horn 101 to transducer 102. Other means of mechanically coupling horn 101 and transducer 102, readily recognizable to persons of ordinary skill in the art, may be used in combination with or in the alternative to the previously enumerated means. Alternatively, horn 101 and transducer 102 may be a single piece. When transducer 102 is mechanically coupled to horn 101, driving transducer 102 with an electrical signal supplied from generator 116 induces ultrasonic vibrations 114 within horn 101. If transducer 102 is a piezoelectric transducer, then the amplitude of the ultrasonic vibrations 114 traveling down the length of horn 101 may be increased by increasing the voltage of the electrical signal driving transducer 102.

As the ultrasonic vibrations 114 travel down the length of horn 101, back wall 104 oscillates back-and-forth. The back-and-forth movement of back wall 104 induces the release of ultrasonic vibrations into the fluids inside chamber 103. Positioning back wall 104 such that at least one point on back wall 104 lies approximately on an antinode of the ultrasonic vibrations 114 passing through horn 101 may maximize the amount and/or amplitude of the ultrasonic vibrations emitted into the fluids in chamber 103. Preferably, the center of back wall 104 lies approximately on an antinode of the ultrasonic vibrations 114. The ultrasonic vibrations emanating from back wall 104, represented by arrows 119, travel towards the front of chamber 103. When the ultrasonic vibrations 119 strike front wall 105 they echo off it, and thus are reflected back into chamber 103. The reflected ultrasonic vibrations 119 then travel towards back wall 104. Traveling towards front wall 105 and then echoing back towards back wall 104, ultrasonic vibrations 119 travel back and forth through chamber 103 in an echoing pattern. As to maximize the echoing of vibrations 119 off front wall 105, it may be desirable to position front wall 105 such that at least one point on it lies on an antinode of the ultrasonic vibrations 114. Preferably, the center of front wall 105 lies approximately on an antinode of the ultrasonic vibrations 114.

The incorporation of protrusions 127 enhances ultrasonic echoing within chamber 103 by increasing the amount of ultrasonic vibrations emitted into chamber 103 and/or by providing a larger surface area from which ultrasonic vibrations echo. The distal or front facing edges of protrusions 127 may emit ultrasonic waves into chamber 103 when the ultrasound transducer 102 is activated. The proximal, or rear facing, and front facing edges of protrusions 127 reflect ultrasonic waves striking the protrusions 127. Emitting and/or reflecting ultrasonic vibrations into chamber 103, protrusions 127 increase the complexity of the echoing pattern of the ultrasonic vibrations within chamber 103. The specific protrusions 127 depicted in FIG. 1A comprise a triangular shape and encircle the cavity. The protrusions may be formed in a variety of shapes such as, but not limited to, convex, spherical, triangular, rectangular, polygonal, and/or any combination thereof. In the alternative or in combination to being a band encircling the chamber, the protrusions may spiral down the chamber similar to the threading within a nut. In combination or in the alternative, the protrusions may be discrete elements secured to a side wall of chamber that do not encircle the chamber. In the alternative or in combination, the protrusions may be integral with side wall or walls of the chamber.

The fluids to be atomized and/or mixed enter chamber 103 of the embodiment depicted in FIG. 1 through at least one channel 109 originating in radial surface 118 and opening into chamber 103. Preferably, channel 109 encompasses a node of the ultrasonic vibrations 114 traveling down the length of the horn. In the alternative or in combination, channel 109 may originate in radial surface 118 and open at back wall 104 into chamber 103. Upon exiting channel 109, the fluids flow through chamber 103. The fluids then exit chamber 103 through channel 110, originating within front wall 105 and terminating within radiation surface 111. As the fluids to be atomized pass through channel 110, the pressure of the fluids decreases while their velocity increases. Thus, as the fluids flow through channel 110, the pressure acting on the fluids is converted to kinetic energy. If the fluids gain sufficient kinetic energy as they pass through channel 110, then the attractive forces between the molecules of the fluids may be broken, causing the fluids to atomize as they exit channel 110 at radiation surface 111. If the fluids passing through horn 101 are to be atomized by the kinetic energy gained from their passage through channel 110, then the maximum height (h) of chamber 103 should be larger than maximum width (w) of channel 110. Preferably, the maximum height of chamber 103 should be approximately 200 times larger than the maximum width of channel 110 or greater.

It is preferable if at least one point on radiation surface 111 lies approximately on an antinode of the ultrasonic vibrations 114 passing through horn 101.

As to simplify manufacturing, ultrasound horn 101 may further comprise cap 112 attached to its distal end. Cap 112 may be mechanically attached (for example, secured with a threaded connector), adhesively attached, and/or welded to the distal end of horn 101. Other means of attaching cap 112 to horn 101, readily recognizable to persons of ordinary skill in the art, may be used in combination with or in the alternative to the previously enumerated means. Comprising front wall 105, channel 110, and radiation surface 111, a removable cap 112 permits the level of fluid atomization and/or the spray pattern produced to be adjusted depending on need and/or circumstances. For instance, the width of channel 110 may need to be adjusted to produce the desired level of atomization with different fluids. The geometrical configuration of the radiation surface may also need to be changed as to create the appropriate spray pattern for different applications. Attaching cap 112 to the present invention at approximately a nodal point of the ultrasonic vibrations 114 passing through horn 101 may help prevent the separation of cap 112 from horn 101 during operation.

It is important to note that fluids of different temperatures may be delivered into chamber 103 as to improve the atomization of the fluids exiting channel 110. This may also change the spray volume, the quality of the spray, and/or expedite the drying process of the fluids sprayed.

Alternative embodiments of an ultrasound horn 101 in accordance with the present invention may possess a single channel 109 opening within side wall 113 of chamber 103. If multiple channels 109 are utilized, they may be aligned along the central axis 120 of horn 101, as depicted in FIG. 1A. Alternatively or in combination, channels 109 may be located on different platans, as depicted in FIG. 1A, and/or the same platan, as depicted in FIG. 1B.

Alternatively or in combination, the fluids to be atomized may enter chamber 103 through a channel 121 originating in proximal surface 117 and opening within back wall 104, as depicted in FIG. 1A. If the fluids passing through horn 101 are to be atomized by the kinetic energy gained from their passage through channel 110, then the maximum width (w') of channel 121 should be smaller than the maximum height of chamber 103. Preferably, the maximum height of chamber 103 should be approximately twenty times larger than the maximum width of channel 121.

A single channel may be used to deliver the fluids to be mixed and/or atomized into chamber 103. When horn 101 includes multiple channels opening into chamber 103, atomization of the fluids may be improved be delivering a gas into chamber 103 through at least one of the channels.

Horn 101 and chamber 103 may be cylindrical, as depicted in FIG. 1. Horn 101 and chamber 103 may also be constructed in other shapes and the shape of chamber 103 need not correspond to the shape of horn 101.

FIG. 2 illustrates a cross-sectional view of an alternative embodiment of the ultrasound atomizing and/or mixing apparatus further comprising an ultrasonic lens 201 within back wall 104 and an ultrasonic lens 202 within front wall 105 containing concave portions 204 and 203, respectively. If the concave portion 204 of lens 201 within back wall 104 form an overall parabolic configuration in at least two dimensions, then the ultrasonic vibrations depicted by arrows 119 emanating from the lens 201 travel in a pattern of convergence towards the parabola's focus 205. As the ultrasonic vibrations 119 converge at focus 205, the ultrasonic energy carried by vibrations 119 may become focused at focus 205. After converging at focus 205, the ultrasonic vibrations 119 diverge and continue towards front wall 105. After striking the concave portion 203 of lens 202 within front wall 105, ultrasonic vibrations 119 are reflected back into chamber 103. If concave portion 203 form an overall parabolic configuration in at least two dimensions, the ultrasonic vibrations 119 echoing backing into chamber 103 may travel in a pattern of convergence towards the parabola's focus. The ultrasonic energy carried by the echoing vibrations and/or the energy they carry may become focused at the focus of the parabola formed by the concave portion 203. Converging as they travel towards front wall 105 and then again as they echo back towards back wall 104, ultrasonic vibrations 119 travel back and forth through chamber 103 in a converging echoing pattern.

In addition to focusing the ultrasonic vibrations 119 and/or the ultrasonic energy they carry, ultrasonic lens 201 and 202 direct the ultrasonic vibrations 119 towards the side walls of the chamber. As such, an increased amount of ultrasonic vibrations emanating from back wall 104 and/or reflecting off front wall 105 strike side wall 113 and become scattered by protrusions 127.

In the embodiment illustrated in FIG. 2 the parabolas formed by concave portions 203 and 204 have a common focus 205. In the alternative, the parabolas may have different foci. However, by sharing a common focus 205, the ultrasonic vibrations 119 emanating and/or echoing off the parabolas and/or the energy the vibrations carry may become focused at focus 205. The fluids passing through chamber 103 are therefore exposed to the greatest concentration of the ultrasonic agitation, cavitation, and/or energy at focus 205. Consequently, the ultrasonically induced mixing of the fluids is greatest at focus 205. Positioning focus 205, or any other focus of a parabola formed by the concave portions 203 and/or 204, at point downstream of the entry of at least two fluids into chamber 103 may maximize the mixing of the fluids entering chamber 103 upstream of the focus.

Figure 3:
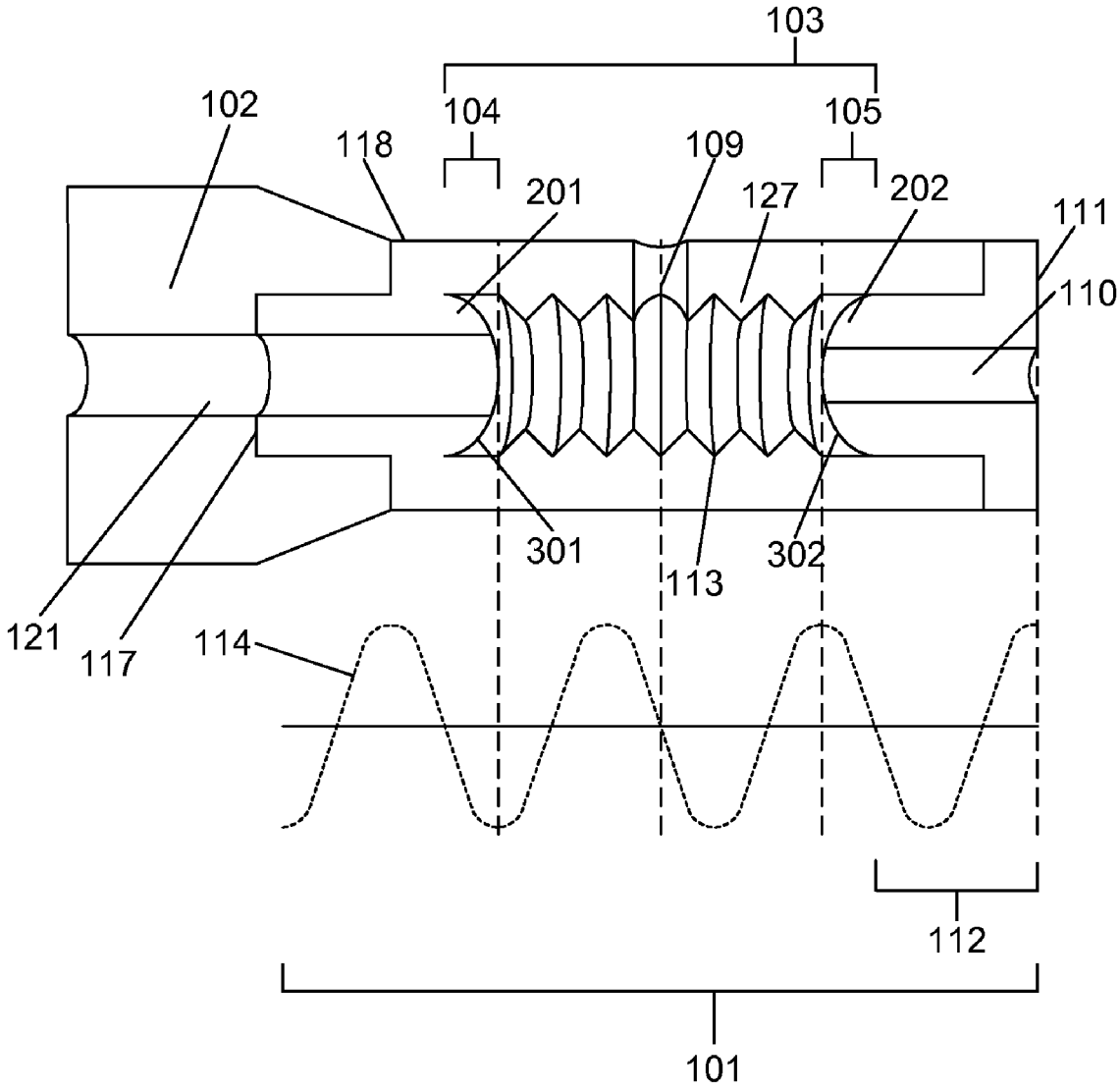
FIG. 3 illustrates a cross-sectional view of an alternative embodiment of the ultrasound atomizing and/or mixing apparatus wherein the back wall and front wall contain lenses with convex portions.

FIG. 3 illustrates a cross-sectional view of an alternative embodiment of the ultrasound atomizing and/or mixing apparatus wherein lens 201 within back wall 104 and lens 202 within front wall 105 contain convex portions 301 and 302, respectively. Ultrasonic vibrations emanating from convex portion 301 of lens 201 travel in a dispersed reflecting pattern towards front wall 105 in the following manner: The ultrasonic vibrations are first directed towards side wall 113 at varying angles of trajectory. The ultrasonic vibrations then reflect off side wall 113 and become scattered by protrusions 127. The scattered ultrasonic vibrations may then travel back towards back wall 104, continue on towards front wall 105, and/or become scattered again by protrusions 127 on another region of side wall 113. Likewise, when the ultrasonic vibrations strike lens 202 within front wall 105, they echo back into chamber 103 towards side wall 113 and become scattered. As such, some of the ultrasonic vibrations echoing off lens 202 may continue on towards back wall 104 after striking side wall 113. Some of the echoing ultrasonic vibrations may travel back towards front wall 105. The remainder may strike another region of side wall 113 and become scattered again.

It should be appreciated that the configuration of the chamber's front wall lens need not match the configuration of the chamber's back wall lens. Furthermore, the lenses within the front and/or back walls of the chamber may comprise any combination of the above mentioned configurations such as, but not limited to, an outer concave portion encircling an inner convex portion.

As the fluids passing through horn 101 exit channel 110, they may be atomized into a spray. In the alternative or in combination, the fluids exiting channel 110 may be atomized into a spray by the ultrasonic vibrations emanating from radiation surface 111. Regardless of whether fluids are atomized as they exit channel 110 and/or by the vibrations emanating from radiation surface 111, the vibrations emanating from the radiation may direct and/or confine the spray produced.

The manner in which ultrasonic vibrations emanating from the radiation surface direct the spray of fluid ejected from channel 110 depends largely upon the conformation of radiation surface 111. FIG. 4 illustrates alternative embodiments of the radiation surface. FIGS. 4A and 4B depict radiation surfaces 111 comprising a planar face producing a roughly column-like spray pattern. Radiation surface 111 may be tapered such that it is narrower than the width of the horn in at least one dimension oriented orthogonal to the central axis 120 of the horn, as depicted FIG. 4B. Ultrasonic vibrations emanating from the radiation surfaces 111 depicted in FIGS. 4A and 4B may direct and confine the vast majority of spray 401 ejected from channel 110 to the outer boundaries of the radiation surfaces 111. Consequently, the majority of spray 401 emitted from channel 110 in FIGS. 4A and 4B is initially confined to the geometric boundaries of the respective radiation surfaces.

The ultrasonic vibrations emitted from the convex portion 403 of the radiation surface 111 depicted in FIG. 4C directs spray 401 radially and longitudinally away from radiation surface 111. Conversely, the ultrasonic vibrations emanating from the concave portion 404 of the radiation surface 111 depicted in FIG. 4E focuses spray 401 through focus 402. Maximizing the focusing of spray 401 towards focus 402 may be accomplished by constructing radiation surface 111 such that focus 402 is the focus of an overall parabolic configuration formed in at least two dimensions by concave portion 404. The radiation surface 111 may also possess a conical portion 405 as depicted in FIG. 4D. Ultrasonic vibrations emanating from the conical portion 405 direct the atomized spray 401 inwards. The radiation surface may possess any combination of the above mentioned configurations such as, but not limited to, an outer concave portion encircling an inner convex portion and/or an outer planar portion encompassing an inner conical portion.

Regardless of the configuration of the radiation surface, adjusting the amplitude of the ultrasonic vibrations traveling down the length of the horn may be useful in focusing the atomized spray produced. The level of confinement obtained by the ultrasonic vibrations emanating from the radiation surface and/or the ultrasonic energy the vibrations carry depends upon the amplitude of the ultrasonic vibrations traveling down horn. As such, increasing the amplitude of the ultrasonic vibrations may narrow the width of the spray pattern produced; thereby focusing the spray produced. For instance, if the fluid spray exceeds the geometric bounds of the radiation surface, i.e. is fanning too wide, increasing the amplitude of the ultrasonic vibrations may narrow the spray. Conversely, if the spray is too narrow, then decreasing the amplitude of the ultrasonic vibrations may widen the spray. If the horn is vibrated in resonance frequency by a piezoelectric transducer attached to its proximal end, increasing the amplitude of the ultrasonic vibrations traveling down the length of the horn may be accomplished by increasing the voltage of the electrical signal driving the transducer.

The horn may be capable of vibrating in resonance at a frequency of approximately 16 kHz or greater. The ultrasonic vibrations traveling down the horn may have an amplitude of approximately 1 micron or greater. It is preferred that the horn be capable of vibrating in resonance at a frequency between approximately 20 kHz and approximately 200 kHz. It is recommended that the horn be capable of vibrating in resonance at a frequency of approximately 30 kHz.

The signal driving the ultrasound transducer may be a sinusoidal wave, square wave, triangular wave, trapezoidal wave, or any combination thereof.

It should be appreciated that elements described with singular articles such as "a", "an", and/or "the" and/or otherwise described singularly may be used in plurality. It should also be appreciated that elements described in plurality may be used singularly.

Although specific embodiments of apparatuses and methods have been illustrated and described herein, it will be appreciated by those of ordinary skill in the art that any arrangement, combination, and/or sequence that is calculated to achieve the same purpose may be substituted for the specific embodiments shown. It is to be understood that the above description is intended to be illustrative and not restrictive. Combinations of the above embodiments and other embodiments as well as combinations and sequences of the above methods and other methods of use will be apparent to individuals possessing skill in the art upon review of the present disclosure.

The scope of the claimed apparatus and methods should be determined with reference to the appended claims, along with the full scope of equivalents to which such claims are entitled.

I claim:

1. An apparatus characterized by:

a. a proximal surface;

b. a radiation surface opposite the proximal surface;

c. at least one radial surface extending between the proximal surface and the radiation surface;

d. an internal chamber containing:

i. a back wall;

ii. a front wall; and iii. at least one side wall extending between the back wall and the front wall;

e. at least one channel originating in a surface other than the radiation surface and opening into the internal chamber;

f. a channel originating in the front wall of the internal chamber and terminating in the radiation surface;

g. at least one protrusion on a side wall of the chamber and extending into the chamber; and h. being capable of vibrating in resonance at a frequency of approximately 16 kHz or greater.

2. The apparatus according to claim 1 further characterized by at least one point on the back wall of the chamber lying approximately on an anti-node of the vibrations of the apparatus.

3. The apparatus according to claim 1 further characterized by at least one point on the radiation surface lying approximately on an anti-node of the vibrations of the apparatus.

4. The apparatus according to claim 1 further characterized by at least one point on the front wall of the chamber lying approximately on a anti-node of the vibrations of the apparatus.

5. The apparatus according to claim 1 further characterized by the channel opening into the chamber originating in a radial surface and opening into a side wall of the internal chamber approximately on a node of the vibrations.

6. The apparatus according to claim 1 further characterized by a transducer attached to the proximal surface.

7. The apparatus according to claim 6 further characterized by a generator to drive the transducer.

8. An apparatus comprising:

a. a proximal surface;

b. a radiation surface opposite the proximal surface;

c. at least one radial surface extending between the proximal surface and the radiation surface;

d. an internal chamber containing:

i. a back wall;

ii. a front wall; and iii. at least one side wall extending between the back wall and the front wall;

e. at least one channel originating in a surface other than the radiation surface and opening into the internal chamber;

f. a channel originating in the front wall of the internal chamber and terminating in the radiation surface; and g. at least one protrusion located on a side wall of the chamber and extending into the chamber.

9. The apparatus according to claim 8 characterized by the maximum height of the internal chamber being larger than the maximum width of the channel originating in the front wall of the internal chamber.

10. The apparatus according to claim 8 characterized by the maximum height of the internal chamber being approximately 200 times larger than the maximum width of the channel originating in the front wall of the internal chamber or greater.

11. The apparatus according to claim 8 characterized by the channel opening into the chamber originating in the proximal surface and opening into the back wall of the internal chamber and the maximum height of the internal chamber being larger than the maximum width of the channel.

12. The apparatus according to claim 8 characterized by the channel opening into the chamber originating in the proximal surface and opening into the back wall of the internal chamber and the maximum height of the internal chamber being approximately 20 times larger than the maximum width of the channel or greater.

13. The apparatus according to claim 8 further comprising an ultrasonic lens within the back wall of the chamber.

14. The apparatus according to claim 13 further comprising one or a plurality of concave portions within the lens within the back wall that form an overall parabolic configuration in at least two dimensions.

15. The apparatus according to claim 13 further comprising at least one convex portion within the lens within the back wall.

16. The apparatus according to claim 8 further comprising an ultrasonic lens within the front wall of the chamber.

17. The apparatus according to claim 16 further comprising one or a plurality of concave portions within the lens within the front wall that form an overall parabolic configuration in at least two dimensions.

18. The apparatus according to claim 16 further comprising at least one convex portion within the lens within the front wall.

19. The apparatus according to claim 8 further comprising at least one planar portion within the radiation surface.

20. The apparatus according to claim 8 further comprising a central axis extending from the proximal surface to the radiation surface and a region of the radiation surface narrower than the width of the apparatus in at least one dimension oriented orthogonal to the central axis.

21. The apparatus according to claim 8 further comprising at least one concave portion within the radiation surface.

22. The apparatus according to claim 8 further comprising at least one convex portion within the radiation surface.

23. The apparatus according to claim 8 further comprising at least one conical portion within the radiation surface.

24. The apparatus according to claim 8 further comprising a transducer attached to the proximal surface capable of vibrating the apparatus according to claim 8 in resonance at a frequency of approximately 16 kHz or greater.

25. The apparatus according to claim 24 further comprising a generator to drive the transducer.

* * * * *